US010308413B2

(12) United States Patent
Usuda

(10) Patent No.: US 10,308,413 B2
(45) Date of Patent: Jun. 4, 2019

(54) FLAT-PACK PACKAGING MATERIAL FOR DRUMS

(71) Applicant: Canopus Co., Ltd., Tokyo (JP)

(72) Inventor: Shinichi Usuda, Tokyo (JP)

( * ) Notice: Subject to any disclaimer, the term of this patent is extended or adjusted under 35 U.S.C. 154(b) by 188 days.

(21) Appl. No.: 15/310,449

(22) PCT Filed: May 8, 2015

(86) PCT No.: PCT/JP2015/063360

§ 371 (c)(1),
(2) Date: Nov. 12, 2016

(87) PCT Pub. No.: WO2015/174350

PCT Pub. Date: Nov. 19, 2015

(65) Prior Publication Data

US 2017/0073135 A1 Mar. 16, 2017

(30) Foreign Application Priority Data

May 15, 2014 (JP) ..... 2014-114386

(51) Int. Cl.
*B65D 77/26* (2006.01)
*B65D 81/02* (2006.01)
(Continued)

(52) U.S. Cl.
CPC ..... *B65D 77/26* (2013.01); *B65D 81/02* (2013.01); *B65D 81/053* (2013.01); *B65D 85/00* (2013.01); *B65D 85/70* (2013.01)

(58) Field of Classification Search
CPC ..... B65D 77/26; B65D 81/05; B65D 81/057; B65D 81/133; B65D 81/053; B65D 77/24
(Continued)

(56) References Cited

U.S. PATENT DOCUMENTS 1,156,074 A * 10/1915 Hahn ..... B65D 5/5035 206/482
2,783,930 A * 3/1957 Riley ..... B65D 5/5054 206/320
(Continued)

FOREIGN PATENT DOCUMENTS

GB 645070 A 10/1950
JP 8-34477 A 2/1996
(Continued)

OTHER PUBLICATIONS

International Search Report completed Aug. 6, 2015 (submitted herewith) of the ISA (Japanese Patent Office), dated Aug. 18, 2015—All references on this document from ISR.
(Continued)

*Primary Examiner* — Steven A. Reynolds
(74) *Attorney, Agent, or Firm* — Patshegen IP LLC; Moshe Pinchas

(57) ABSTRACT

Provided is an inexpensive packaging member whereby musical drums can be packaged for transportation, in a short time and in the most compact manner, and can be safely transported. The packaging member can be inexpensively produced using a simple structure whereby cardboard or other sheet member is cut in a predefined shape and perforations are made therein. Furthermore, the packaging member is flat-packed and therefore does not occupy space during transportation and storage. In addition, packaging time can be shortened and drums can be safely transported. The flat-packed packaging member can be reused countless times if the contents are the same size.

2 Claims, 11 Drawing Sheets

(51) Int. Cl.
*B65D 85/00* (2006.01)
*B65D 81/05* (2006.01)

(58) Field of Classification Search
USPC ..... 206/314, 499, 585, 586, 446, 395, 396
See application file for complete search history.

(56) References Cited

U.S. PATENT DOCUMENTS 3,107,780 A * 10/1963 Stuckert ..... B65D 5/5038 206/320
3,159,273 A * 12/1964 Schecterson ..... B65D 5/5038 206/45.28
3,339,821 A * 9/1967 Wojcik ..... B65D 5/5011 206/446
4,019,672 A * 4/1977 Giannini ..... B65D 5/5069 206/320
4,375,261 A * 3/1983 Kitchell ..... B65D 5/5035 206/320
4,773,531 A * 9/1988 Tudor ..... B65D 57/00 206/256
5,407,077 A * 4/1995 Sinclair, Sr. ..... B65D 81/05 206/446
5,743,393 A * 4/1998 Webb ..... B65D 85/68 206/319
6,057,499 A 5/2000 Basmadjian
6,092,654 A * 7/2000 Webb ..... B65D 5/5045 206/319
7,014,160 B2 * 3/2006 Muyskens ..... B65D 5/5035 206/320
7,648,026 B2 * 1/2010 Brittain ..... B65D 5/5054 206/320
9,731,861 B2 * 8/2017 Cram ..... B65D 19/44

FOREIGN PATENT DOCUMENTS

JP H08 34477 A 2/1996
JP 2001-58676 A 3/2001
JP 2012 041082 A 3/2012
WO 2010/060167 A2 6/2010

OTHER PUBLICATIONS

Extended European Search Report dated Dec. 20, 2017.

* cited by examiner

[Fig-1]
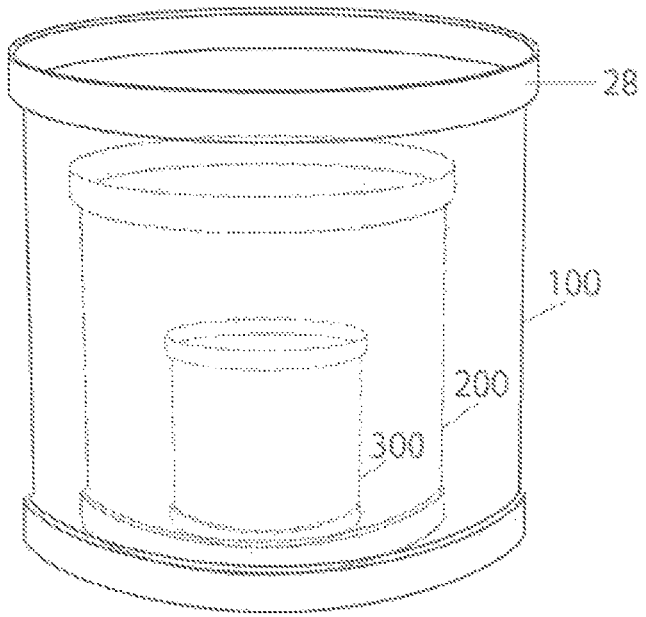
[Fig-2]
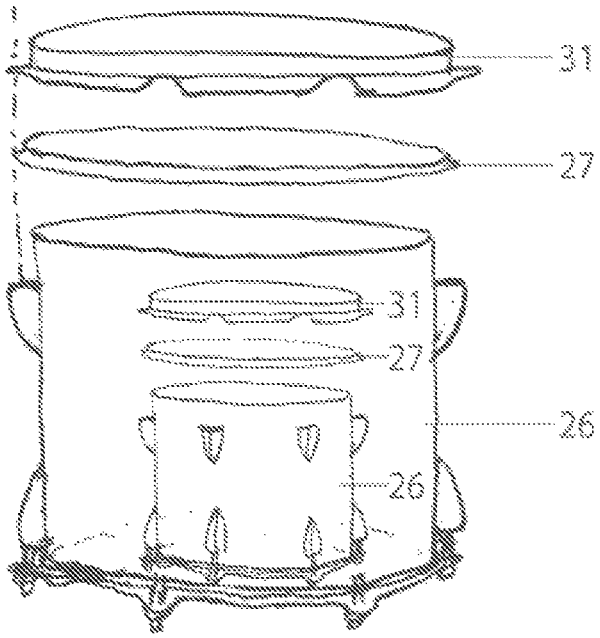

[Fig-3]
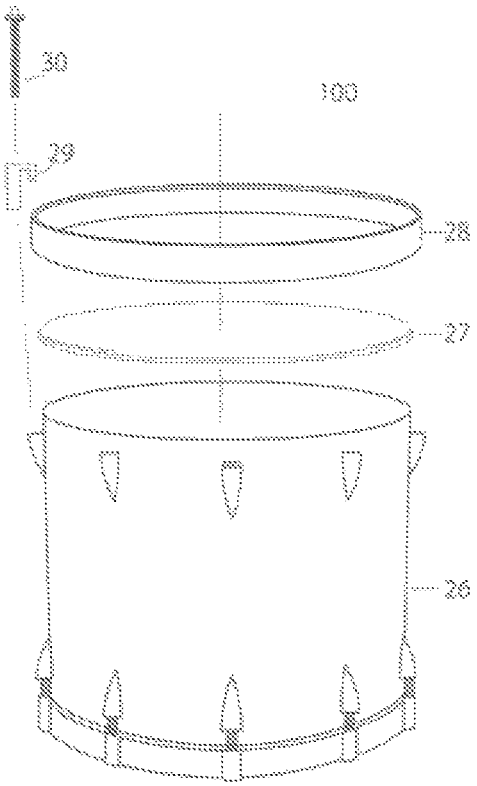

[Fig-4]
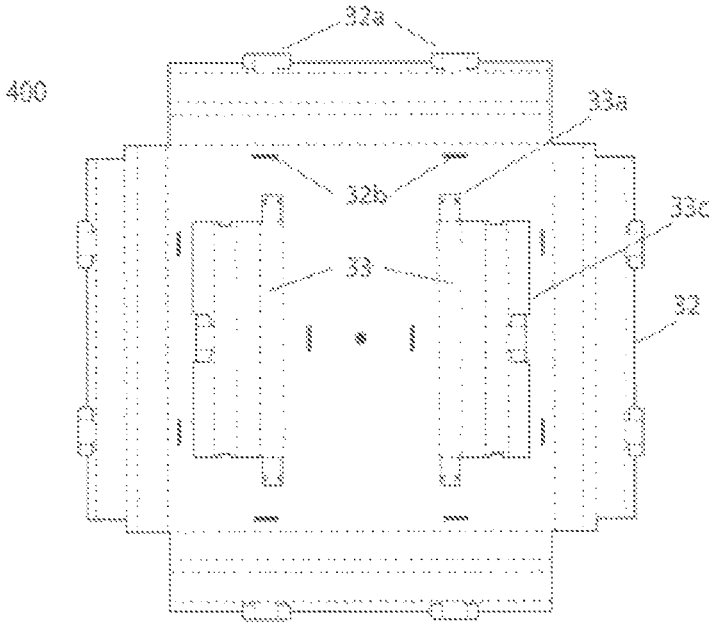
[Fig-5]
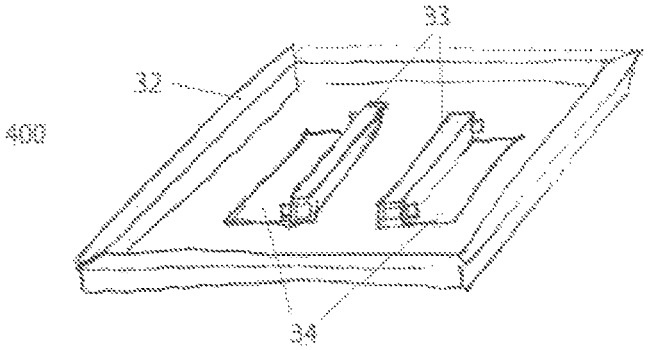
[Fig-6]
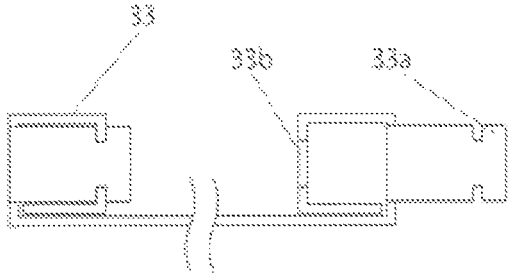

[Fig-7]
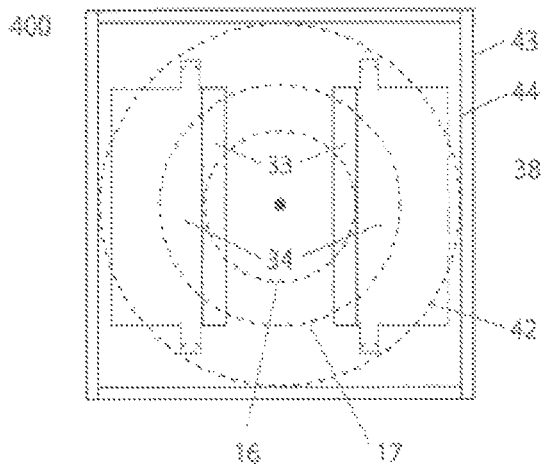
[Fig-8]
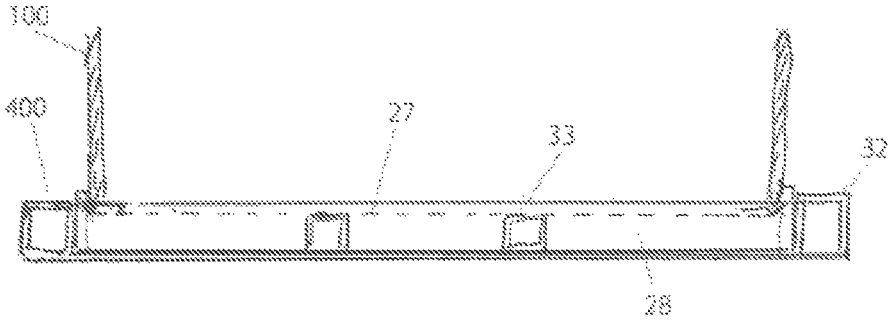
[Fig-9]
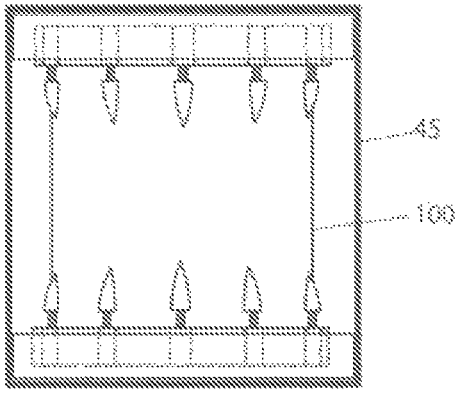

[Fig-10]
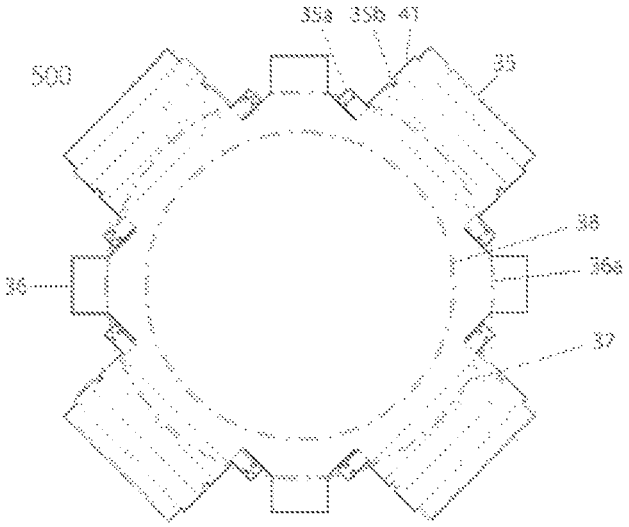
[Fig-11]
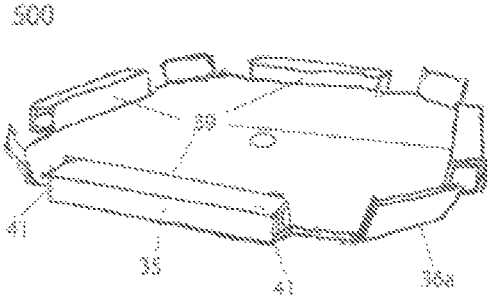
[Fig-12]
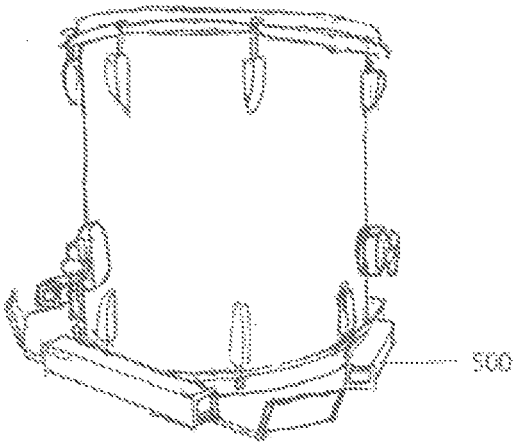

[Fig-13]
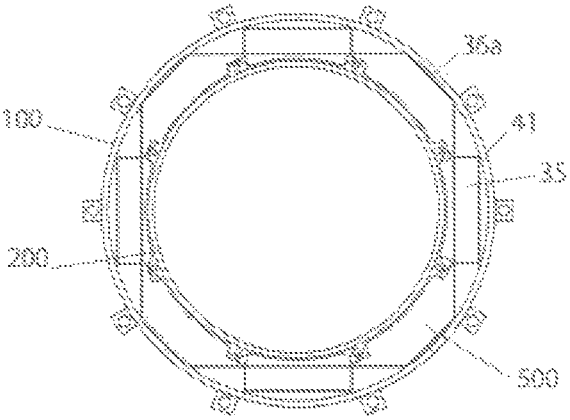
[Fig-14]
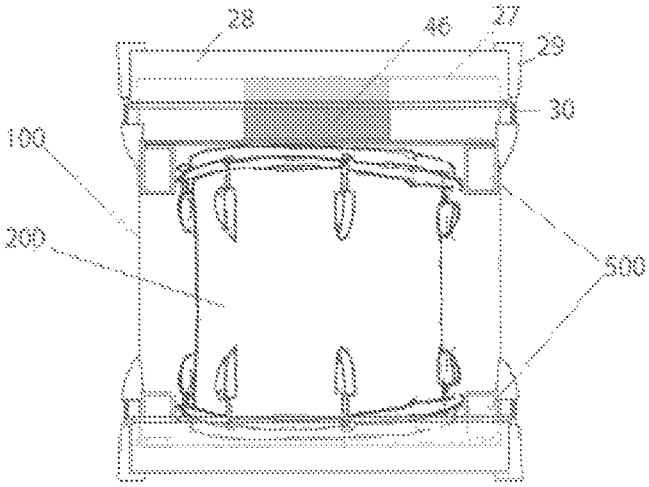
[Fig-15]
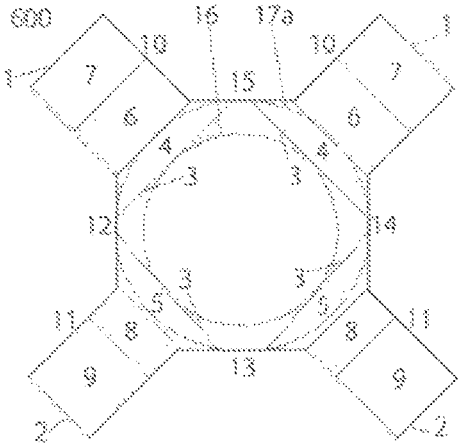

[Fig-16]
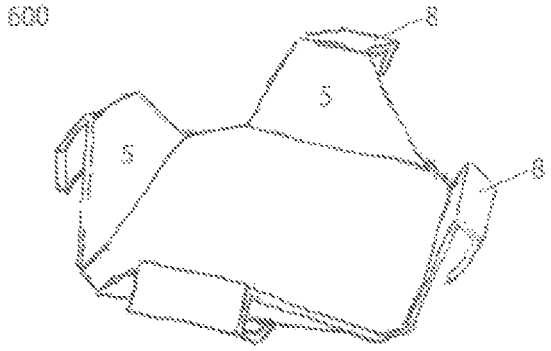
[Fig-17]
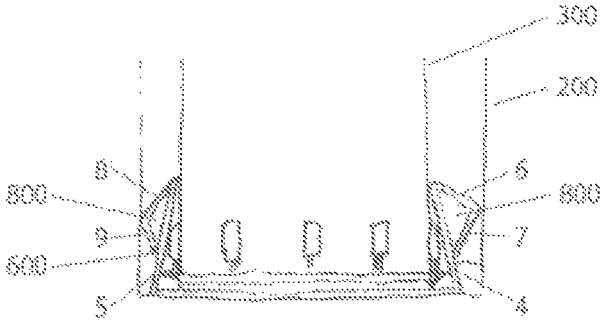
[Fig-18]
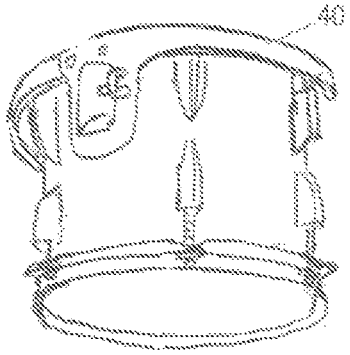

[Fig-19]
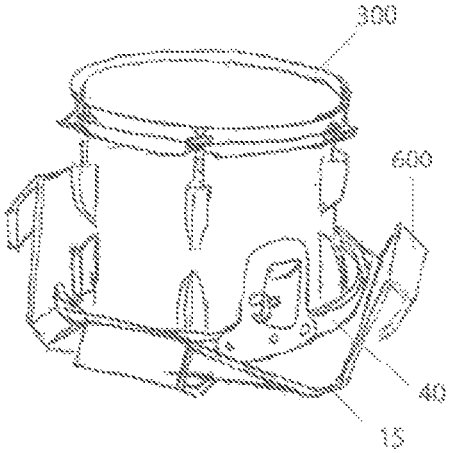
[Fig-20]
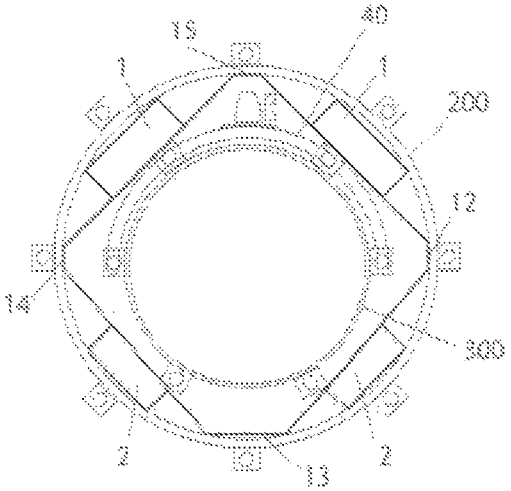
[Fig-21]
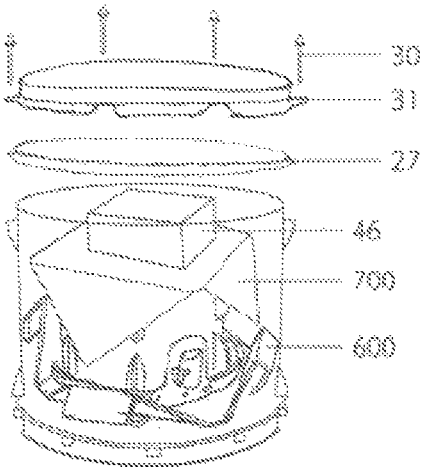

[Fig-22]
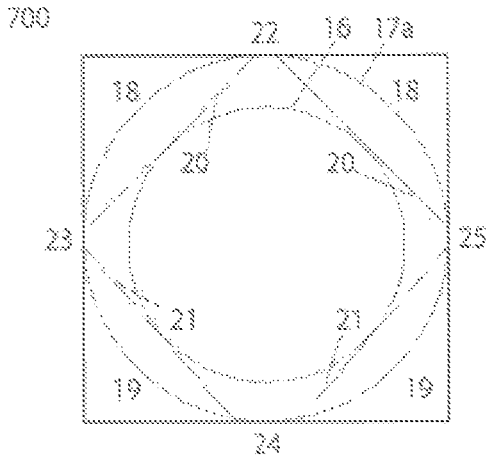
[Fig-23]
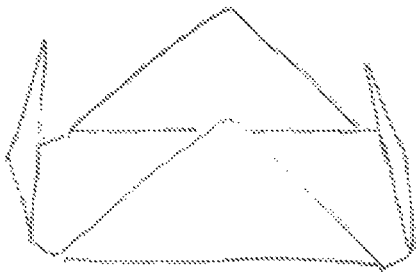
[Fig-24]
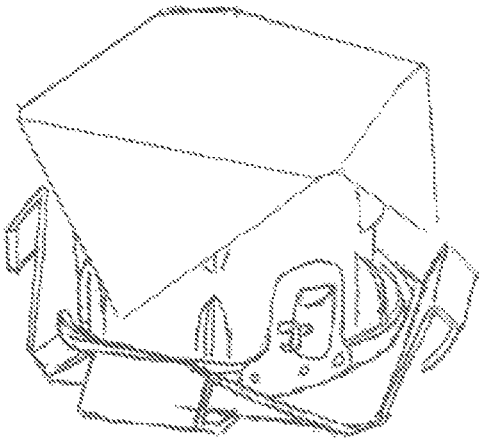

[Fig-25]
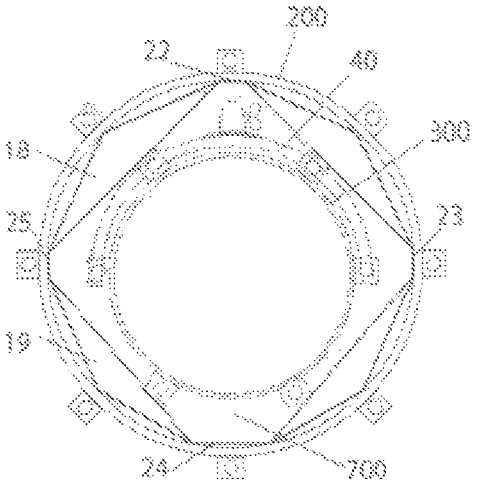
[Fig-26]
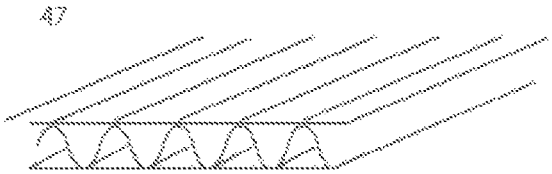
[Fig-27]
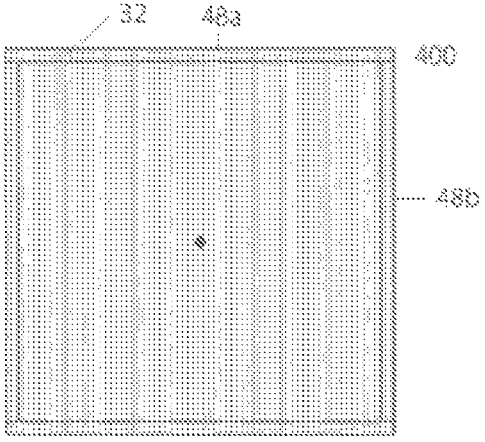

[Fig-28]
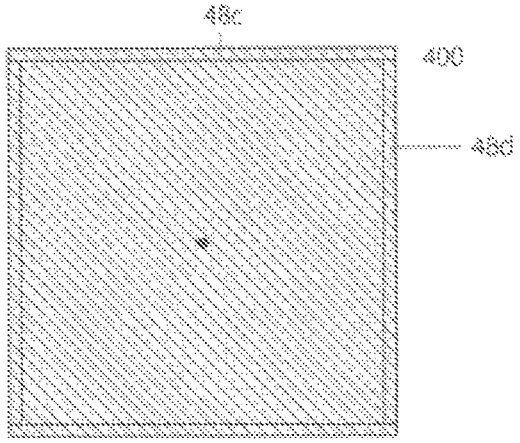
[Fig-29]
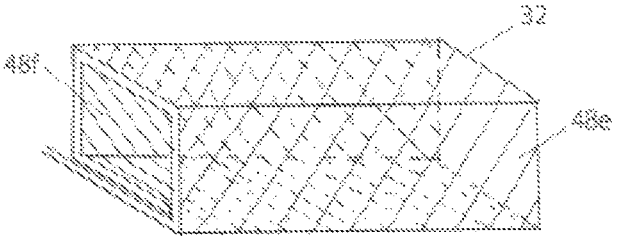

FLAT-PACK PACKAGING MATERIAL FOR DRUMS

FIELD OF THE INVENTION

The invention, constituting a flat-pack packaging assembly whereby drums used for musical instruments can be packaged for transportation, especially packaged in a short time to the minimum volume, relates to the inexpensive packaging material that can be safely transported.

BACKGROUND OF THE INVENTION

The body of a drum used as musical instrument, in terms of its structure, is almost hollow inside. Therefore, in order to reduce the transportation expenses, the method to make the package size smaller is taken by placing smaller drum shells inside bigger drum shells.

SUMMARY OF THE INVENTION

Problem to be Solved by the Invention

There exists the following problems for a way of packaging by this method.

1. Since smaller drum shells are packaged into the bigger drum shells, breakage often occurs.
2. Since packaging assemblies do not have a fixed form, it takes a lot of time to package.
3. The packaging assembly, once used and completed, becomes rather bulky and takes a lot of space in storage.
4. The total weight of the packaging tends to be heavier as it is filled with smaller drums inside. So, potentially the place where the outer drum makes contact with its packaging assembly may be damaged by its weight.

Means for Solving the Problem

This invention adopts the following packaging assembly in order to solve the above mentioned problems.

1. /a plate of corrugated cardboard cut out into a fixed form, configured to be assembled without use of glue or metal fittings.
2. The corrugated cardboard, is arranged diagonally with respect to the cutting direction of a buffer section formed by the corrugated panel, such that the buffer section provides the same strength at any angle.
3. The corrugated cardboard includes perforations on the surface thereof such that it can be folded into a predefined form, and can be easily assembled in short time into the predefined form of a packaging members.
4. A part of packaging assembly which is folded increases the strength of the packaging members and protects the commercial products inside and absorbs shocks from outside at the same time.
5. Circular cylindrical shape drum can easily be set into cubic packaging members as its feature.
6. Circular cylindrical drum can be securely fixed in the circular cylindrical drum.
7. In the a folding position of the packaging assembly the members include a buffer section made of a piece of corrugated cardboard, is set the small sized drum in place, at the same time, the external shape of the folded packaging assembly is anchored at the inner periphery of the stored drum.

In order to solve these problems as mentioned above, according to this invention, a hollow space is formed by inwardly folding up a part of corrugated cardboard at multiple spots on the circumference of a sheet of corrugated cardboard. The folding of the corrugated cardboard allows securing the outer periphery line of a drum from outside by forming the exterior buffer material. In the inside empty space of the above mentioned cardboard, the formation of a hollow space, allows to support the drum head of the above mentioned drum by forming the inner buffer material, and flat-pack packaging assembly is provided.

Also, in order to solve the above mentioned problems, according to this invention, 4 sides (32) of a piece of polygonal corrugated cardboard (400) are folded up inwardly to form a quadrangular prisms of buffer material at the 4 corners, and in the interspace of the quadrangular prisms, 4 points from the outside on the periphery line (42) of stored bass drum (100) can be fixed, and a flat-pack buffer material of the quadrangular prism at the center of the corrugated cardboard (400) is constituted, and the drum head (27) of the bass drum (100) which receives the full weight of drums is supported from below as its feature, and flat-pack packaging assembly is provided.

Also, in order to solve the above mentioned problems, according to this invention, in order to store firmly a smaller drum (300) inside a bigger drum (200), Flat-pack packaging assembly includes a first packaging member (700) and second packaging member (600). By folding the above mentioned first packaging member (700) on the inside, it can wrap around the periphery of the bottom (16) of the above mentioned smaller drum (300) from outside and the edges (22, 23, 24, and 25) which defined of the first packaging member, make contact with the inner circumferential line (17*a*) of the above mentioned bigger drum (200).

Wing-like large protrusion (1) and small protrusion (2) defined on the inside of the above mentioned second packaging member (600), are configured to firmly hold the periphery of the above mentioned smaller drum. The wing-like large protrusion (1) and small protrusion (2) of the above mentioned second packaging member can be folded outwardly, such that the shape when viewed from the side forms a hollow portion, and the hollow portion make contact with the above mentioned large drum, and the above mentioned folded second packaging member and its edges (12, 13, 14, and 15) make contact with the inner periphery of larger drum (200) and flat-pack packaging member is provided.

Also, in order to solve the above mentioned problems, according to this invention, by folding a piece of square corrugated cardboard for packaging (600 in FIG. 22) equally on the inside (in the shape such as FIG. 23) at the folding line (20 and 21 in FIG. 22), and at the same time to wrap around the bottom circumference (16) from outside at 4 places on the tom tom (300), the edges (22, 23, 24, and 25) of 4 corners of the folded corrugated cardboard make contact with the inner circumferential line (17*a*), a tom tom (300) into a floor tom (200) (safely and simply) is securely stored in the flat-pack packaging material.

By folding the wing-like large protrusion (1) and small protrusion (2) of a piece of polygonal packaging material to fix an upper portion of tom tom (600 in FIG. 15) from a position at the folding line (3) on the inside, and an upper section of circumference (16) of tom tom (300) with suspension mount (40) for tom tom or fixing 4 points on the circumference of tom tom without suspension mount (40).

Furthermore, by folding the wing-like large protrusion (1) and small protrusion (2) of packaging material (600) at the folding lines (10 and 11) where divide buffer materials (6, 7 and 8, 9) into two, it composes a scalene triangle (800 in FIG. 17) when viewed from the side, which absorbs shock from outside, at the same time, packaging material (12, 13, 14 and 15 of 600) makes contact with (FIG. 20) the inner circumferential line (17*a*) of floor tom (200), and flat-pack packaging material is provided (a set of 2 pieces of corrugated cardboards for drums used such as FIG. 21, tom tom (300) is firmly and safely fixed on floor tom (200)).

In this invention, (in order to enhance the strength of the quadrangular prism of buffer material (32) of packaging material that's made of corrugated cardboard, such as a piece of cut-polygonal packaging material (400), as FIG. 28) corrugated cardboard may be cut in such a way that the corrugated direction of the corrugated cardboard can be arranged diagonally.

Effects of the Invention

According to this invention, it has the following effects.

1. The packaging assembly is made at the low price and using the simple process of cutting corrugated cardboards or the like and perforating them.
2. Before assembly, very little space is taken in transportation and storage because of the flat plate-like form of the packaging assembly. Subsequently expenses for transport and storage can be reduced.
3. A part of the assembled packaging assembly increases the strength of packaging members and works as buffer material, such that it is unnecessary to place buffer material in the carton box as in the conventional method. In that way, labor and packaging expenses can be reduced.
4. Cylindrical drums, which are hard to package, can be stored in a carton box of the quadrangular prism or into a main body of the cylindrical drum safely with the minimum packaging material in a short time.

BRIEF DESCRIPTION OF THE DRAWINGS

FIG. 1 The figure shows tom tom (300) stored inside a floor tom (200) which is stored inside a bass drum (100).

FIG. 2 The figure shows not only the component structure of floor tom (200) and tom tom (300) but tom tom (300) which is stored in the floor tom (200).

FIG. 3 The figure shows a block diagram of bass drum (100).

FIG. 4 The figure shows a deployed view of packaging material (400) for bass drum (100).

FIG. 5 The figure shows a perspective view of the above packaging material.

FIG. 6 The figure shows a first member sectional view of flat-pack buffer section 33.

FIG. 7 The figure shows a top view of the buffer section with which (33) the bass drum (100), floor tom (200), and tom tom (300) make contact when bass drum (300) is placed on the packaging material (400).

FIG. 8 The figure shows a side view of bass drum (100) which is placed on the packaging material (400).

FIG. 9 The figure shows a view of bass drum (100) which is stored in the carton box using the packaging material (400).

FIG. 10 The figure shows a deployed view of packaging material for floor tom (200).

FIG. 11 The figure shows a perspective view of the assembled packaging material (500).

FIG. 12 The figure shows a perspective view of floor tom (200) placed on the packaging material (500).

FIG. 13 The figure shows an overhead view of packaging material (500) put into the bass drum 100.

FIG. 14 The figure shows a side view of floor tom (200) packaged with the packaging material (500) in bass drum (100).

FIG. 15 The figure shows a deployed view of packaging material (600) for fixing the lower section of tom tom (300).

FIG. 16 The figure shows a perspective view of packaging material (600).

FIG. 17 The figure shows a side view of tom tom (300) fixed with the packaging material (600) in floor tom (200).

FIG. 18 The figure shows tom tom (300) with suspension mount (40) on tom tom (300).

FIG. 19 The figure shows tom tom (300) with suspension mount (40) and placed upside-down on the assembled packaging material (600).

FIG. 20 The figure shows an overhead view of tom tom (300) as FIG. 19 stored upside-down in floor tom (200) put into packaging material (600).

FIG. 21 The figure shows a perspective view of tom tom (300) stored in floor tom (200) using the packaging materials (600 and 700).

FIG. 22 The figure shows the deployed view of packaging material (700) for fixing the upper section of floor tom (200) for storing tom tom (300).

FIG. 23 The figure shows a perspective view of packaging material (700) for fixing the upper section.

FIG. 24 The figure shows a perspective view of the installed state that packaging material (600) for fixing the lower section and packaging material (700) for fixing the upper section, used for when tom tom (300) is stored in floor tom 200, are installed on tom tom (300).

FIG. 25 The figure is an overhead view of the fixed state that torn tom (300) is stored in floor tom (200) as FIG. 21 and covered with packaging material (700) from above.

FIG. 26 The figure shows a corrugated sheet of corrugated cardboard.

FIG. 27 The figure shows an overhead view of packaging material which is made by arranging flute (corrugated sheet) of carton box lengthwise.

FIG. 28 The figure shows an overhead view of packaging material which is made by arranging the flute (corrugated sheet) of corrugated cardboard diagonally.

FIG. 29 The figure shows the buffer material 32 which is formed by rolling up corrugated cardboard.

DESCRIPTION OF THE PREFERRED EMBODIMENTS

The preferred embodiment of this invention is explained in detail by referring to the attached figures as below. It should be noted that repeated explanation shall be omitted by assigning an identical code to the components which possess the identical functional configuration stated in the detailed explanation and figures.

(1) Explanation on the Packaging Method for Drums of Different Sizes (FIG. 1 to FIG. 3)

In general, the drums, as musical instruments, are played by using plural drums varying in the size. FIG. 1 shows the method to package drums in the minimum size. FIG. 2 shows the component structure of floor tom (200) and tom tom (300), and it also shows tom tom (300) stored in floor tom (200). As shown in FIG. 1 and FIG. 2, bass drum (100) accommodates floor tom (200), while the floor tom (200) accommodates a tom tom (300).

Bass drum (100) includes of drum shell (26), skin of drum which is drum head (27), rim for bass drum (28), hook (29) and bolt (30) as FIG. 3. In order to store tom tom (300) inside the floor tom (200), bolt (30) of the floor tom (200), tom tom (300), rim (31) of the floor tom (200) and drum head (27) thereof are removed in sequence.

The packaging size can be made smaller by using this packaging method, however, the problem is that inner drums suffer damage due to contact with each other in transit. In order to solve these problems, the simple packaging assembly and packaging method is explained in the present embodiment.

(2) Explanation of the Packaging Member for Storing the Filled Bass Drum (100) in the Carton Box 45 (FIG. 4 to FIG. 9)

It's explained about the packaging member for storing stuffed bass drum in the carton box (45). FIG. 4 is the deployed view of packaging member (400). FIG. 5 is the perspective view of packaging member (400). FIG. 6 is the sectional view of a prefabricated buffer section (33) of the packaging member (400).

Folding up a section of the packaging member in FIG. 4 on the inside, and inserting 2 stoppers (32*a*) which are on each side into, inserting slot (32*b*) and fixing them. Forming thereby a buffer section (32) formed as a quadrangular prism that can hold rim (28) on bass drum (100) from outside.

When the packaging member (400) is assembled as shown in FIG. 7, the inside surface thereof (44) is designed such that periphery line (42) of bass drum (100) to be housed is on the same line, therefore, these inside surface secures bass drum (100) from outside. The packaging member (400) is further designed such that the outside surface thereof (43) firmly secures the inside of packaging member of corrugated cardboard (45) which houses bass drum (100) and works as buffer material.

Furthermore, folding on the inside 2 incisions (33) which are at the center of packaging material (400), prefabricated buffer section to sustain drumhead of bass drum is completed by inserting stopper (33*a*) into chase (33*b*) which forms the quadrangular prism.

The packaging member (400) is disposed inside the carton box (45), the bass drum (100) is placed on it and is covered with packaging member (400) from the top then packaging is completed by closing the lid of carton box (45). FIG. 8 is a side view of the bottom of bass drum (100) when placed in the packaging member (400), by using the packaging member (400). FIG. 9 is a side view of bass drum (100) when housed in the carton box and the like by using the packaging member (400).

In this way, by supporting the drumhead (27) of drum (100), with buffer section (33) of packaging member (400), the total weight of tom tom (300) and floor tom (200) is not concentrated solely on hoop (28) as in the past, but the weight is dispersed throughout the buffer section. Accordingly, even when impact is applied to carton box (45) it can protect drums in the carton box safely and securely without damaging hoop (28).

(3) Explanation of Packaging Member for Housing Floor Tom (200), into Bass Drum (100). (FIG. 10 to FIG. 14)

Next is explanation regarding the packaging member for housing floor tom (200), into bass drum (100). FIG. 10 is the deployed view of packaging member (500). Folding the wing (35) which works as buffer section for packaging member (500) inward, assemble it as FIG. 11. Likewise, folding the protrusion (36) inward, and assembling it as FIG. 11.

The packaging member (500) includes a buffer section (35) formed as quadrangular prism at 4 places on the packaging member (500) as shown in FIG. 10. The buffer section (35) can be made by folding the wing (35) inward such that it is designed to hold down the periphery line (38) of floor tom (200). The edges (41) of buffer section (35) on the quadrangular prisms at 4 places of packaging member (500) which are assembled at the same time, and the edge (36*a*) which is made by protrusion (36) of packaging member (500) that is folded inward is designed to make contact with the inner circumference line (37) of bass drum (100). As shown on FIG. 11, buffer section (35) of quadrangular prism works as buffer material between the inner circumference line of bass drum (100) and periphery line (38) of floor tom (200), and works to fix floor tom (200) inside bass drum (100) safely and securely as shown in FIG. 13.

FIG. 12 shows the installed state of floor tom (200) inside the packaging member 500. In order to house floor tom (200) inside bass drum (100), as shown in FIG. 13, the packaging member (500) is disposed on the inside of bass drum (100) and floor tom (200) is housed therein.

After that, the floor tom (200) is covered with packaging member (500) from the top. FIG. 14 is the side view of floor tom (200) housed in the bass drum (100). When packaging member (500) is placed on the floor tom (200) and housed in the bass drum 100, a gap is formed due to the difference of height between bass drum (100) and floor tom (200) as shown in FIG. 14. In order to fill the gap, box (46) is placed on the packaging member (500), so that the floor tom can be fixed to the bass drum, following which the drum head (27) of bass drum (100) is placed, the rim (28) is installed, and the hooks (29) and bolts (30) are mounted.

(4) Explanation of the Folding of Packaging Member of the Tom Tom. (FIG. 15 to FIG. 25)

Packaging member (600) includes a wing-like large protrusion (1) and a small protrusion (2) as FIG. 15. Along the folding line (3), defined on the periphery line (16) of tom tom (300), folding the inner wall surfaces (4 and 5) upright on the inside so as to surround tom tom (300), and folding the outer wall surfaces (6, 7 and 8, 9) on the outside along the polygonal lines (10 and 11). FIG. 16 is the perspective view of packaging member 600. Folded carton box as 800 in FIG. 17 forms a scalene triangle, and this form secures tom tom (300), and at the same time works as to absorb shocks on tom tom (300) from outside.

The periphery line (16) of packaging member (600) is made slightly larger than the periphery of tom tom (300) such that tom tom (300) with suspension mount (40) can be housed thereby. Thus, packaging member (600) is it works well in all cases such as size difference by the manufacturers or things like suspension mount (40) for tom tom is installed.

Though the outer size of tom tom (300) with brackets and others is not constant, by the repulsive force of bended corrugated cardboard, the small and large outer wall surfaces (6, 7 and 8, 9) as FIG. 15 are forced on the inside. Even though the size of tom tom (300) may vary slightly, the inner wall surfaces (4 and 5) can adequately respond to it. The more uncertain size of drum the more easily secured.

Moreover, since the large and small outer wall surfaces (6, 7 and 8, 9) are not fixed, it has been so designed to absorb shock when taken from outside. In order to obtain efficacy from these, the tom tom (300) which is to be housed is placed upside down with or without the suspension mount (40) for tom tom. In addition, arranging the position where the suspension mount of tom tom is installed to correspond with the position of the edge (15).

FIG. 19 shows tom tom (300) placed upside down on the assembled packaging member (600). FIG. 20 is the overhead view of floor tom stuffed with the packaging member (800) and housed as FIG. 19 tom tom (300) upside down. FIG. 21 is the side view of tom tom (300) housed in floor tom (200) using packaging member (600 and 700).

When the packaging member (600) is assembled, it is designed such that the sides (12, 13, 14 and 15) are aligned on the inner circumference line (17*a*) and these sides firmly fix tom tom (300) inside of floor tom (200).

In order to house tom tom (300) inside floor tom (200), the sides (18 and 19) of packaging member (700) are bent for fixing the upper section of tom tom as in FIG. 22, along the polygonal lines (20 and 21). It then takes the shape shown in FIG. 23.

In the state that became this shape, from above the tom tom (300) which was already housed in floor tom 200, it is fitted to floor tom (200) so as to cover as shown in FIG. 24.

At this time, the suspension mount (40) on tom tom comes to the direction of edge 22. FIG. 21 shows the perspective view to indicate the state that tom tom (300) wrapped with packaging member of (600 and 700) as in FIG. 24 is housed in floor tom (200).

When housed in this way, empty space is generated because the height of tom tom (300) is shorter than that of floor tom (200). In that case, by placing a carton box (46) to fill the space, it can be firmly fixed.

Packaging member 700 as FIG. 25 is designed that the edges (22, 23, 24 and 25) align on the inner circumference line (17*a*) and these sides firmly fix tom tom (300) along the inner circumference line (17*a*).

As FIG. 21, after tom tom (300) is housed in floor tom (200) with every packaging member, by placing drum head (27) and rim (31) on, the drum is completed with bolt (30).

(5) Explanation about Carton Box (FIG. 26 to FIG. 29)

FIG. 26 shows the corrugated sheet of carton box. Taking packaging member (400) for example, Corrugated sheet (47) of buffer section (32) of the quadrangular prism which is on the level in FIG. 27 becomes the perpendicular 48*a* to the buffer section (32). It works effectively enough to serve as buffer section against the impact from the outside, however, since the direction of corrugated sheet (47) of buffer section (32) which is vertical, becomes parallel 48*b* to the buffer section (32), it can not repel the shock from outside, it is not the structure to absorb impact from outside.

Therefore, in this embodiment, when cutting packaging member, by cutting the corrugated sheet (47) at 45 degrees with respect to the direction of the corrugation as shown in FIG. 28, buffer section (32) in FIG. 29 can always maintain 45 degrees whether it is on the vertical line or horizontal line. Furthermore, buffer section (32) which is formed by folding up corrugated cardboard, as FIG. 29, the direction of outer corrugated sheet (48*e*) becomes an opposite direction of inner corrugated sheet (48*f*). The strength increases moreover, by forming a shape of the triangle which forms 90 degrees of the interior angle of the vertex, and the structure can fully absorb impact from outside.

The explanation above was made about the preferred embodiments of this invention with reference to the attached drawings, it is needless to say that this invention is not limited to such specific examples constituting this invention. To the person concerned, it is obvious that one may arrive at the various examples of changes or modification within the category of listed scope of patent claims, thus it is generally understood that those things belong to the technical scope of the present invention.

The above described embodiment, for example, explained when cutting packaging members, by cutting the corrugated sheet (47) at 45 degrees for an element as shown in FIG. 28, but this invention is not limited to. It is not necessary to arrange the direction of corrugated sheet of packaging members (carton box) on a slant when cutting it, and it is not needed to be cut at 45 degrees even when it needs to cut.

Also, in the above described embodiment, explanation was made about folding up 4 sides (32) of polygonal shape of a carton box (400) to form the buffer section of quadrangular prism at the 4 corners of carton box (400), inside the space of quadrangular prism, fix 4 points from outside of the peripheral line (42) of bass drum (100) which is to be housed. The present invention is not limited to the above mentioned. By rolling up multiple positions on the surroundings of a piece of corrugated cardboard from the inside, bass drum can be supported stably by fixing at least 3 points of the peripheral line of bass drum. Using this invention, it is not only limited to bass drum, but to any arbitrary drum.

Also, in the above described embodiment, explanation was made about, by using the packaging member (600) for fixing the upper section of tom tom and a square carton box (700) for packaging, explained about the housing tom tom (300) in floor tom (200), this invention is not limited to the above mentioned.

Using this invention, it is possible to house the small drum into the bigger drum in every aspect.

Also, in the above described embodiment, explanation was made that to fold a square carton box (700) for packaging at the folding lines (20 and 21) evenly on the inside, wrapping around the peripheral line of bottom section of tom tom 300 from outside, the edges (22, 23, 24 and 25) at four corners which are formed by the folded carton box make contact with the inner circumferential line (17*a*) of floor tom (200), and tom tom (300) can be stored and fixed in floor tom (200). This invention is not limited to the above mentioned. The shape of carton box is not limited to quadrangle, but any arbitrary shape can be used. And folding the places are not limited to 4 points but multiple arbitrary points.

Also, in the above described embodiment, explanation was made that to fold on the inside at the folding lines (3) the wing-like large protrusion (1) and small protrusion (2) on the packaging member (600) which is for fixing the upper section of polygonal tom tom, to fix the upper periphery line of tom tom (300) with suspension mount for tom tom, this invention is not limited to the above mentioned. It could be fixed on the periphery of tom tom without suspension mount (small drum to be housed in bigger drum). Also, when fixing tom tom (the small drum to be housed in the bigger drum) it can be fixed at any place and number of places can be arbitrary.

Also, in the above described embodiment, explanation was made that to bend on the outside the wing-like large protrusion (1) and small protrusion (2) on the packaging member (600), at the folding lines (10 and 11) which dimidiate buffer section (6, 7 and 8, 9) and constitute a scalene triangle (800) at its side view, and packaging member (12, 13, 14 and 15) makes contact with the inner circumference line (17*a*) of floor tom (200).

This invention is not limited to the above mentioned. The shape which formed by folding packaging member need not to be a scalene triangle, as long as it forms the arbitrary hollow state.

DESCRIPTION OF THE ELEMENTS

100 bass drum
200 floor tom
300 tom tom
400 packaging member for bass drum
500 packaging member for floor tom
600 packaging member for fixing the lower section of tom tom

700 packaging member for fixing upper section of tom tom
800 scalene triangle which is formed by wing 1 and 2 of packaging member for fixing lower section of tom tom
1 wing-like large protrusion of packaging member 600
2 Wing-like small protrusion of packaging member 600
3 Folding line of periphery line of tom tom 300
4 inner wall surface of suspension mount 47 for fixing tom tom 300 of packaging member 600
5 inner wall surface for fixing tom tom 300 of packaging member 600
6 outer wall surface large 1 of packaging member 600
7 outer wall surface large 2 of packaging member 600
8 outer wall surface small 1 of packaging member 600
9 outer wall surface small 2 of packaging member 600
10 polygonal line of outer wall surface large 1 of packaging member 600
11 polygonal line of outer wall surface small 2 of packaging member
12 left side edge which makes contact with inner circumferential line of floor tom 200
13 edge of the other side of tom tom 300 with suspension mount 47
14 right side edge that makes contact with the inner circumferential line of floor tom 200
15 edge of tom tom 300 with suspension mount
16 periphery line of tom tom 300
17 periphery line of floor tom 200
17*a* inner circumferential line of floor tom 200
18 side of packaging member 700 with suspension mount of tom tom
19 the opposite side of tom tom with suspension mount of packaging member 700
20 polygonal line of tom tom with suspension mount of packaging member 700
21 polygonal line of opposite side of tom tom with suspension mount of packaging member 700
22 side that with suspension mount 40 at the edge of packaging member 700
23 left side at the edge of packaging member 700
24 side that without suspension mount 40 at the edge of packaging member 700
25 right side at the edge of packaging member 700
26 the body
27 drumhead
28 rim for bass drum
29 hook
30 bolt
31 rim for tom tom 200, floor tom 300
32 assembly parts which works as buffer section of packaging member 400
32*a* stopper that is to fix buffer section 32
32*b* groove that is to stop stopper 32*a*
33 prefabricated buffer section of quadrangular prism which underprop drumhead of bass drum
33*a* topper for assembling buffer section of quadrangular prism
33*b* groove that is to stop stopper 33*a*
34 opening section of bottom of packaging member 400 when assembling prefabricated buffer section 33
35 buffer section of quadrangular prism of packaging member 500
35*a* stopper for fixing buffer section 35 of packaging member 500
35*b* groove that is to stop stopper 35*a* of packaging member 500
36 protrusion of packaging member 500
36*a* edge which is made when folding protrusion 36 of packaging member 500
37 inner circumferential line of bass drum 100
38 periphery of floor tom 200
39 edge which buffer section of packaging member fixes fixing floor tom 200 from the outside
40 suspension mount of tom tom
41 edge of buffer section 35
42 periphery line of bass drum 100
43 outside side of packaging member 400
44 inside surface of packaging member 400
45 carton box in which bass drum to be placed
46 box to fill space which occurs at the time of packaging
47 corrugated sheet of corrugated cardboard
48*a* direction of corrugated sheet of horizontal quadrangular prism of conventional packaging member
48*b* direction of corrugated sheet of vertical quadrangular prism of conventional packaging member
48*c* direction of corrugated sheet of horizontal quadrangular prism of packaging member 400
48*d* direction of corrugated sheet of vertical quadrangular prism of packaging member 400
48*e* direction of outside corrugated sheet of buffer section of 32
48*f* direction of inside corrugated sheet of buffer section of 32

The invention claimed is:

1. A packaging assembly for drums, the packaging assembly comprising:

a first packing member formed from a cardboard including multiple folding lines configured for inwardly folding said packing member forming thereby a plurality of buffer sections each having a shape of a quadrangular prism defined at the periphery of said cardboard and being configured to support an outer periphery line of a first drum;

wherein said first packing member further includes an additional buffer section formed at the center of said packing member and being configured to protrude upwardly from a surface of the cardboard so as to support a head portion of a drum;

a second packaging member formed from a second cardboard provided with folding lines configured to be folded to form thereby four wings defined at the edge of said second packaging member and protrudes sideward from the second packaging member, said second packaging member is configured to support a second drum disposed inside said first drum such that said wings, when folded, being configured to extend between an outer periphery line of said second drum and an inner periphery line of said first drum such that when said second drum is disposed at the center of said second packaging member said wings are disposed around said second drum; and a third packaging member configured to be disposed on top of said second drum, and wherein said second packaging member includes a box configured to fill in a space formed between a top portion of said second drum and a top portion of said first drum when said second drum is disposed inside said first drum.

2. The packaging assembly of claim 1 wherein said cardboard is made of a corrugated sheet in which a corrugated direction is arranged diagonally with respect to said folding lines.

* * * * *